US010801803B1

(12) United States Patent
Rentz

(10) Patent No.: US 10,801,803 B1
(45) Date of Patent: Oct. 13, 2020

(54) ARCHERY RELEASE

(71) Applicant: Gregory E. Summers, Madison Heights, VA (US)

(72) Inventor: Marc Rentz, Madison Heights, VA (US)

(73) Assignee: Gregory E. Summers, Madison Heights, VA (US)

( * ) Notice: Subject to any disclaimer, the term of this patent is extended or adjusted under 35 U.S.C. 154(b) by 0 days.

(21) Appl. No.: 16/522,903

(22) Filed: Jul. 26, 2019

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | | |
|---|---|---|---|---|
| 4,036,204 | A * | 7/1977 | Scott | F41B 5/1469 124/35.2 |
| 4,969,448 | A * | 11/1990 | Beyer | F41B 5/1469 124/35.1 |
| 5,031,600 | A * | 7/1991 | Moore | F41B 5/1469 124/35.2 |
| 9,250,032 | B2 * | 2/2016 | Kelly | F41B 5/1469 |
| 9,429,384 | B2 * | 8/2016 | Whalen | F41B 5/1469 |
| 9,857,139 | B2 * | 1/2018 | Kelly | F41B 5/1469 |
| 10,012,467 | B2 * | 7/2018 | Meadows | F41B 5/1469 |

* cited by examiner

*Primary Examiner* — John A Ricci
(74) *Attorney, Agent, or Firm* — Leading Edge Law Group PLC

(57) ABSTRACT

A handheld archery release is convertible between index and pinky finger trigger modes of operation. The release includes a flat finger bed handle which contains a sear assembly operable between hold and fire positions. Index and pinky finger triggers are connected with the handle and with the sear assembly to selectively operate the sear assembly in either mode of operation. Locking screws selectively lock one of the triggers when the other trigger is in operation.

18 Claims, 11 Drawing Sheets

4a
40
40b 14
40
38
14a
20c 6
34
22
32
28
30
26
24
12
40
36
20
20a
14
40
38

6

12a
20b
36
12
40

ARCHERY RELEASE

BACKGROUND OF THE INVENTION

The present invention relates to an archery release, and more particularly to a handheld archery release for a bowstring which includes an index finger trigger.

Release devices are used in archery to assist the archer in pulling a bowstring to a fully drawn position and then releasing the bowstring to fire an arrow. Some release devices use a trigger to fire a shot, which can lead to less accuracy due to the archer knowing when the shot is fired, resulting in flinching or punching the trigger. Still other devices use back tension to fire the shot, where the archer is not aware of when the shot will fire because there is no trigger. A back tension firing motion cannot be anticipated, resulting in greater accuracy due to the shot going off without the archer flinching, punching or otherwise pulling the bow off target during the time period that the arrow is being propelled by the bowstring. The present invention relates to a new handheld release that features an index finger trigger on a handheld release aid. The release may also include a fourth or pinky finger trigger and is convertible between index and pinky finger operation for firing an arrow.

BRIEF DESCRIPTION OF THE PRIOR ART

There are many thumb trigger, relax thumb trigger, ring finger trigger, pinky trigger and hinging or pressure activated (without a trigger) hand held release aids known in the archery release art. Also known are index finger trigger releases where the archer grasps a tube or other configured device wherein the head of the release is extended forward, outwardly from the hand. Prior index finger releases are wrist strap releases wherein the wrist strap holds the weight of the bow draw forces and the releases are activated by an index trigger finger.

While the prior devices normally operate satisfactorily, they are somewhat limited in that they are operable only via hinge movement. In certain situations, it is desirable to operate a release via a trigger rather than via a hinge to accommodate various shooting styles. However, modifying prior handheld releases which include a neck portion with a head and jaw extending outwardly between the index and middle finger to include an index finger trigger would not permit the archer to successfully draw a bow.

SUMMARY OF THE INVENTION

The present archery release was developed in order to overcome these and other drawbacks of prior archery releases by providing a release that includes a flat finger bed handle having a longitudinal axis, a sear assembly connected with the handle and operable between hold and fire positions, and an index finger trigger connected with the handle to selectively operate the sear assembly.

The sear assembly includes a cocking bar, a toggle and a hook, all of which are pivotally connected with the handle. The cocking bar is operable by the index trigger finger between cocked and release positions. When the index finger trigger is operated, the cocking bar is released to displace the toggle toward the fire position of the hook.

According to a preferred embodiment, a pinky finger trigger is also connected with the handle to selectively operate the sear assembly. The index and pinky finger triggers are both operable between locked and released positions. A spring is arranged between the handle and the cocking bar to bias the cocking bar to the release position when one of the index and pinky fingers are operable.

More particularly, the cocking bar includes first and second portions at opposite ends thereof which engage the index finger trigger when the index finger trigger is in the released position and the pinky finger trigger when the pinky finger trigger is in the released position, respectively. Locking screws are provided for both the index and pinky finger triggers so that the archer may selectively lock one of the finger triggers when the other is in the released position. A trigger in the locked position does not engage the cocking bar.

The handle is preferably formed of a pair of concave mating handle portions which define an internal cavity which contains at least a portion of the sear assembly and the triggers.

The index finger trigger extends co-axially with the handle longitudinal axis and the handle includes a surface portion spaced from index finger trigger and configured to support the index finger of the archer when the archery bow is drawn. The handle further contains a through opening having an axis that extends normal to the longitudinal axis of the handle and which is configured to receive the middle finger of the release hand of the archer. At least one insert is removably connected with the handle adjacent the through opening. The insert contains an opening co-axial with the through opening but having a diameter less than the diameter of the through opening. The archer may select and install an insert of the proper inner diameter to customize the fit of the release to the archer's middle finger.

BRIEF DESCRIPTION OF THE FIGURES

Other objects and advantages of the invention will become apparent from a study of the following specification when viewed in the light of the accompanying drawing, in which:

FIGS. 17*a*-16*f* are front perspective, rear perspective, front, rear, top and bottom views, respectively, of an insert for a second side of archery release opposite the first side.

DETAILED DESCRIPTION

Figure 6:
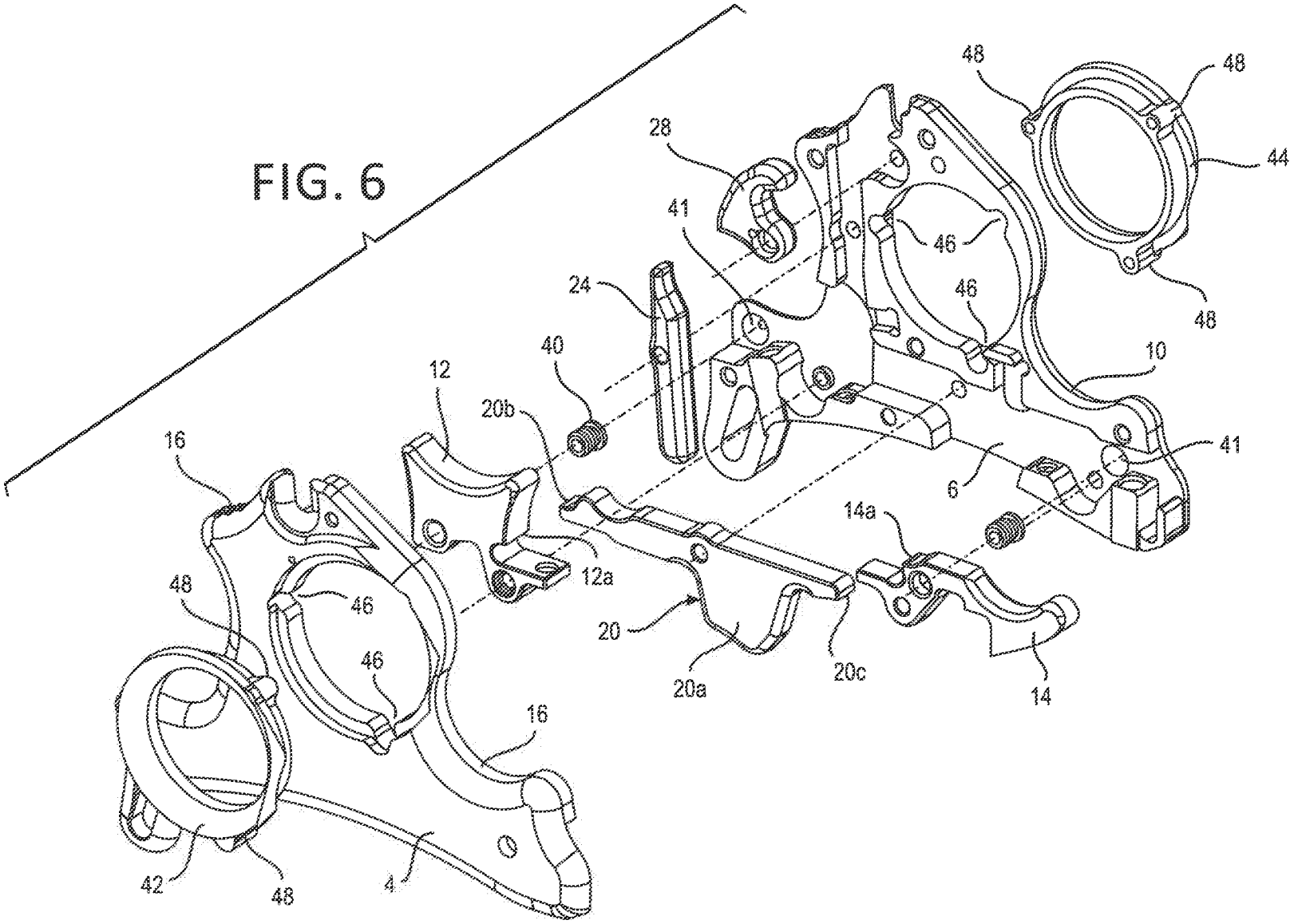
FIG. 6 is an exploded view of the archery release.

As shown in FIGS. 1-6, the handheld archery release includes a number of components which are shown in greater detail in FIGS. 8-17. More particularly, the release includes a handle 2 having a longitudinal axis A. The handle is of the flat finger bed type and is formed from two mating generally concave sections 4, 6 which when joined define a chamber within the handle as shown in FIGS. 6 and 7. The first or front handle section 4 is shown in detail in FIGS. 8*a*-8*f* and the second or rear handle section 6 is shown in detail in FIGS. 9*a*-9*g*. The handle sections contain openings which are aligned when the sections are brought together in contiguous relation for receiving screws or other fastening devices (not shown) to connect the handle sections together. The handle contains a lateral through opening 8 having an axis normal to the longitudinal axis A of the handle for receiving a second or middle finger of an archer and a recess 10 in an upper surface behind the opening for receiving the third or ring finger of the archer. As will be developed below, an index finger trigger 12 is connected with the handle 2 forward of the opening 8 and a pinky finger trigger 14 is connected with the handle at the rear end. The index finger trigger is operable by the first or index finger of the archer and the pinky finger trigger is operable by the fourth or pinky finger of the archer. The handle further includes a knurled surface 16 for supporting the archer's index finger during draw of a bow.

At the forward end of the handle 2 beneath the index finger trigger 12 is a slot which receives a mounting screw for a thumb support 18. The thumb support is adjustable within the slot according to the preferences of the archer.

Figures 7, 7A, 7B, 9D, 10:
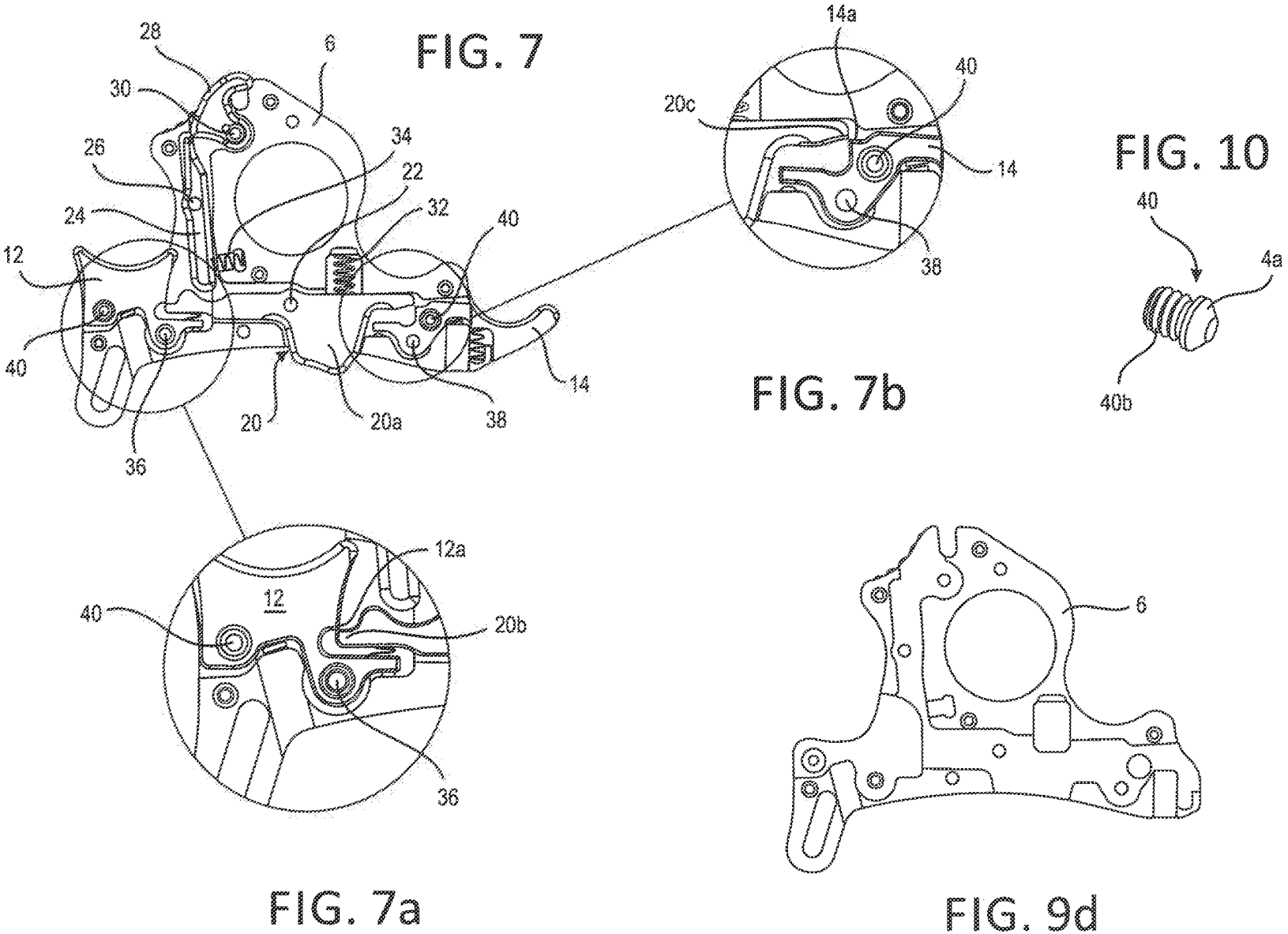
FIG. 7 is an interior view of the archery release with one of the handle portions removed.
FIGS. 7*a* and 7*b* are detailed views of the portions encapsulated by lines 7*a* and 7*b*, respectively, of FIG. 7.
FIGS. 9*a*-9*g* are front perspective, rear perspective, front, rear, right side, left side, and bottom views, respectively, of the other of the handle portions of the archery release.
FIG. 10 is a perspective view of a trigger locking screw of the archery release.
Figure 8A:
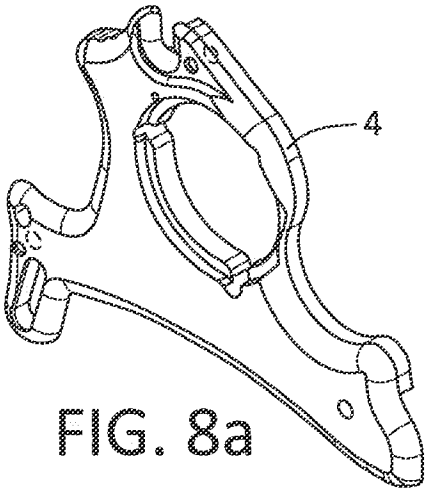
FIGS. 8*a*-8*f* are front perspective, rear perspective, front, right side, left side and bottom views, respectively, of one of the handle portions of the archery release.
Figure 8B:
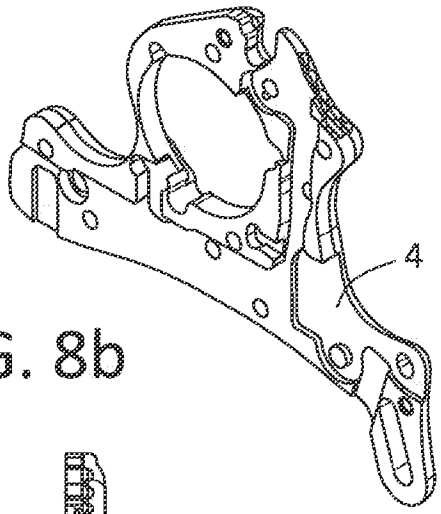
Figure 8C:
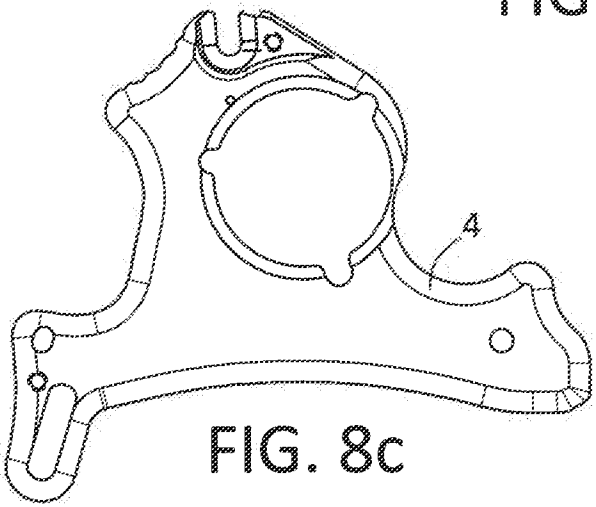
Figure 8D:
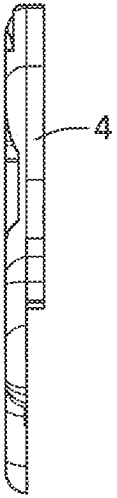
Figure 8E:
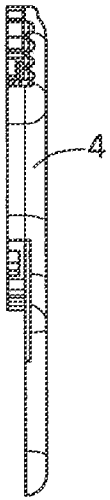
Figure 8F:
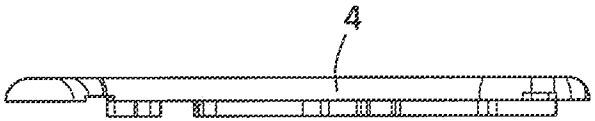
Figure 9A:
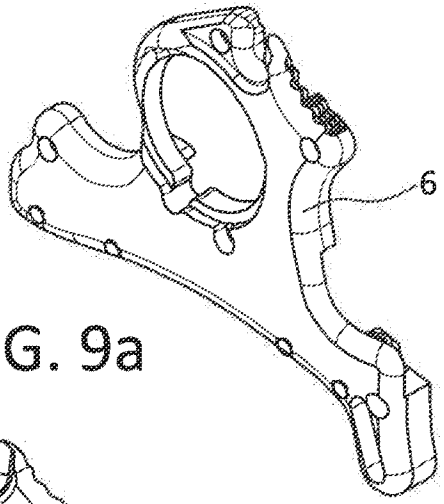
Figure 9B:
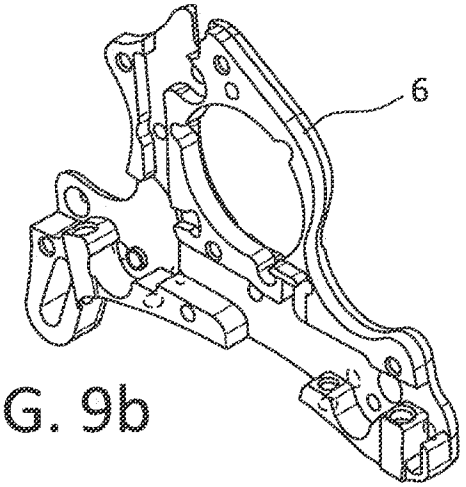
Figure 9C:
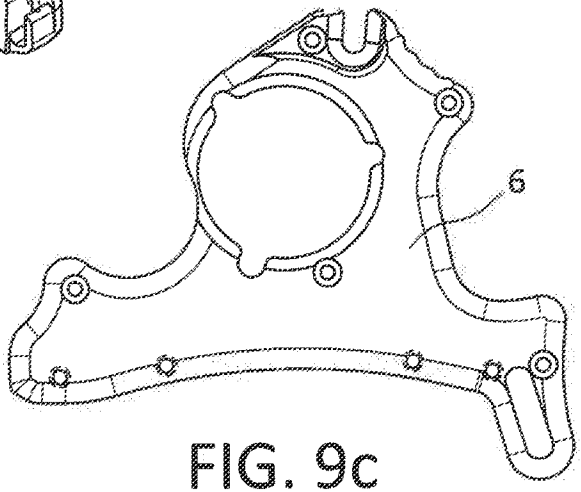
Figure 9E:
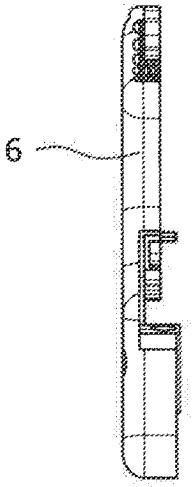
Figure 9G:
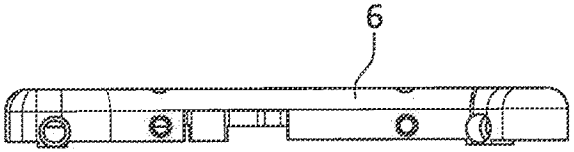
Figure 9F:
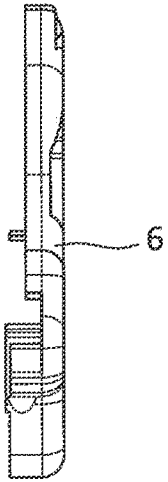
Figure 11B:
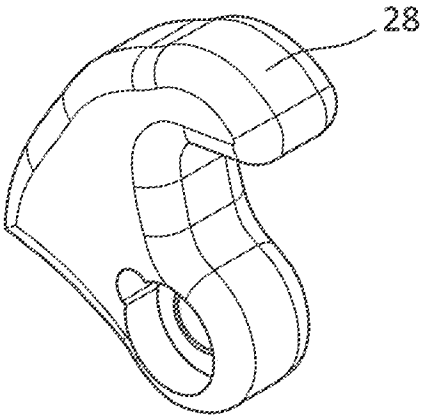
FIGS. 11*a*-11*e* are front perspective, rear perspective, front, right side and rear views, respectively, of the hook of the archery release.
Figure 11A:
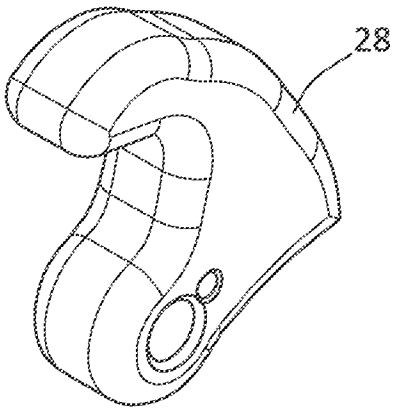
Figure 11E:
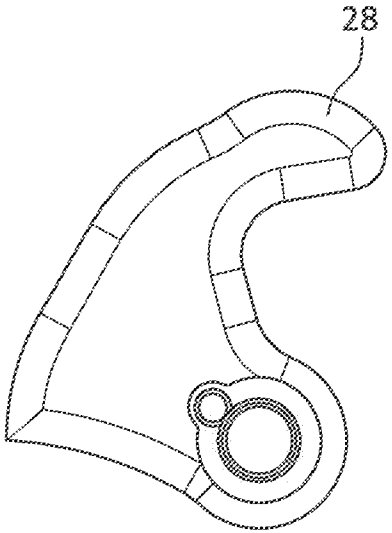
Figure 11D:
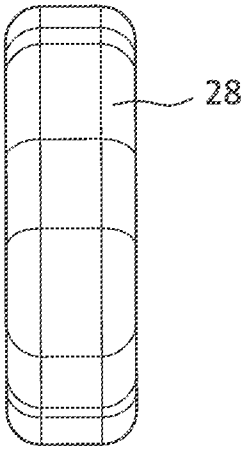
Figure 11C:
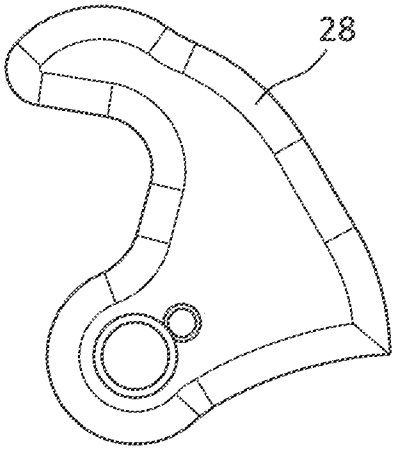
Figure 12B:
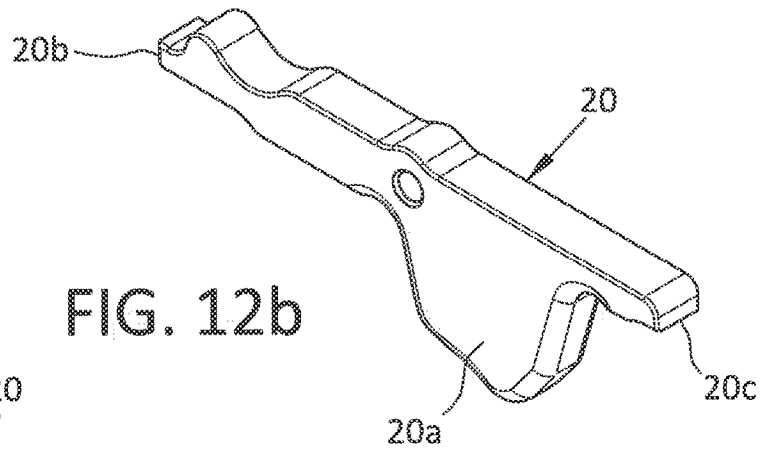
FIGS. 12*a*-12*d* are front perspective, rear perspective, front and bottom views, respectively, of the cocking bar of the archery release.
Figure 12C:
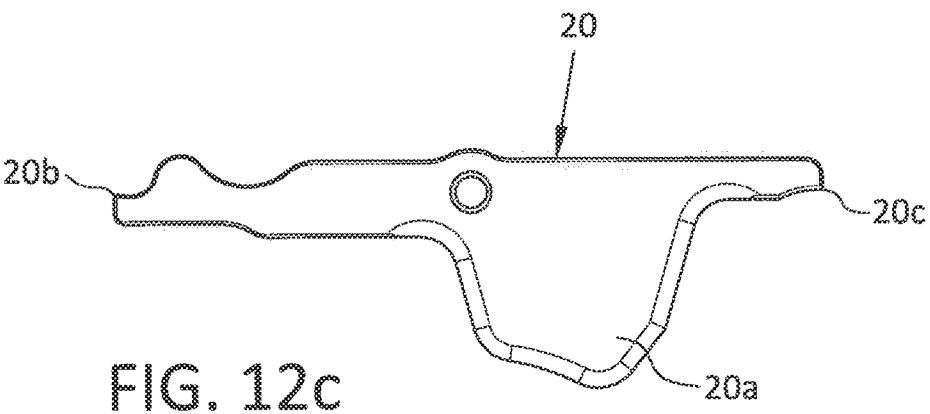
Figure 12D:
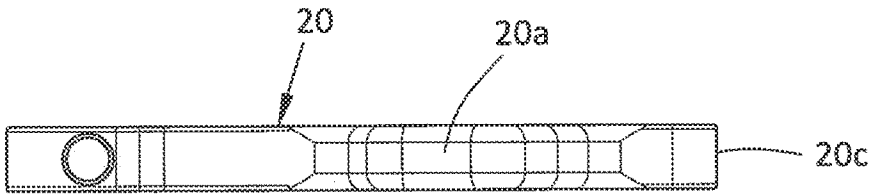
Figure 12A:
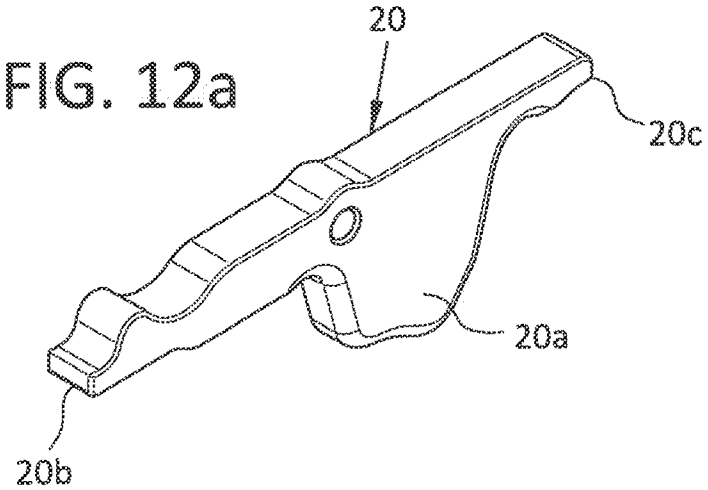
Figure 13A:
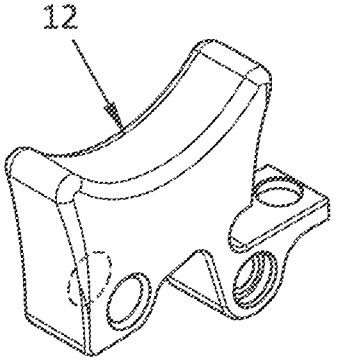
FIGS. 13*a*-13*e* are front perspective, rear perspective, front, right side and rear views, respectively, of the index finger trigger of the archery release.
Figure 13B:
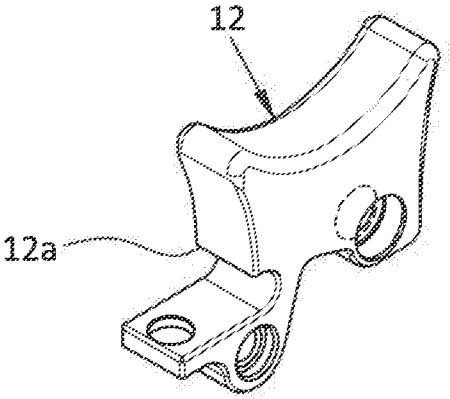
Figure 13C:
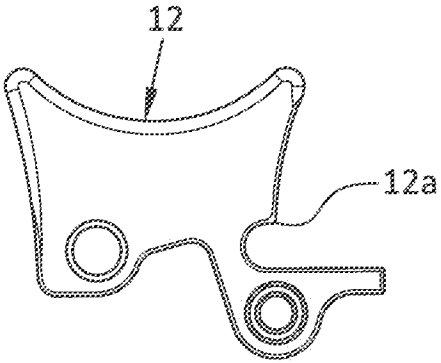
Figure 13D:
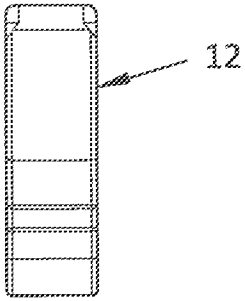
Figure 13E:
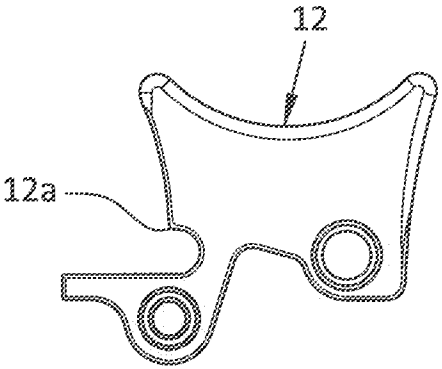
Figure 14B:
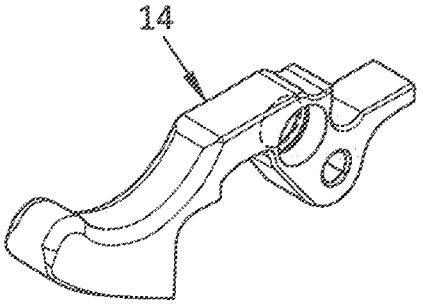
FIGS. 14*a*-14*f* are front perspective, rear perspective, front, right side, rear, and bottom views, respectively, of the pinky trigger of the archery release.
Figure 14E:
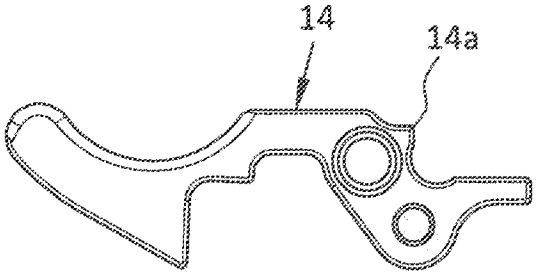
Figure 14D:
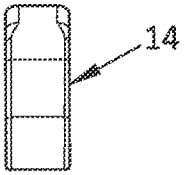
Figure 14A:
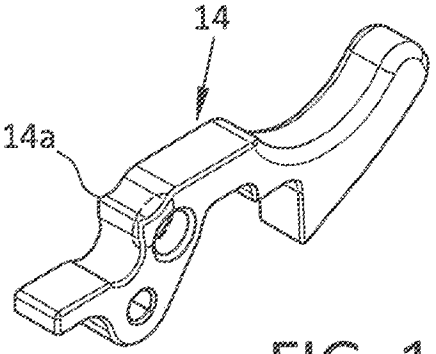
Figure 14C:
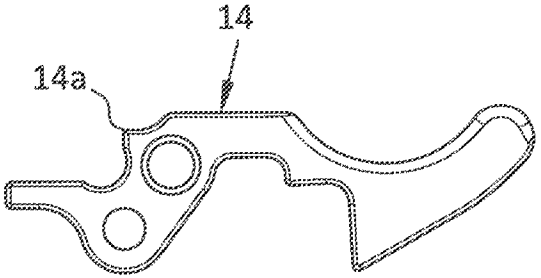
Figure 14F:
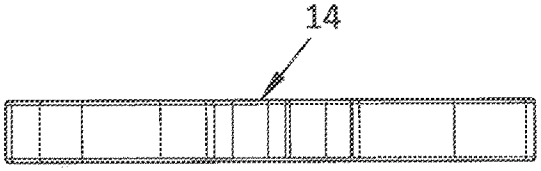
Figure 15B:
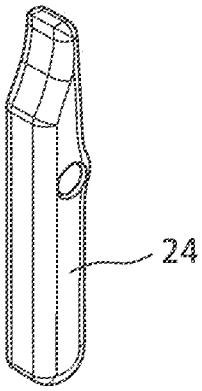
FIGS. 15*a*-15*d* are front perspective, rear perspective, front and right side views, respectively, of the toggle of the archery release.
Figure 15D:
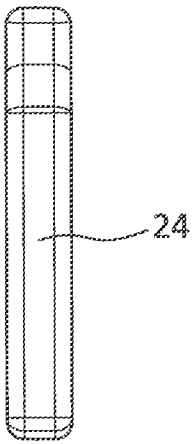
Figure 15A:
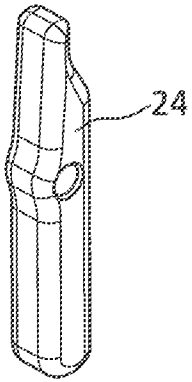
Figure 15C:
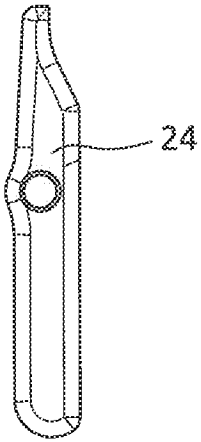
Figure 17A:
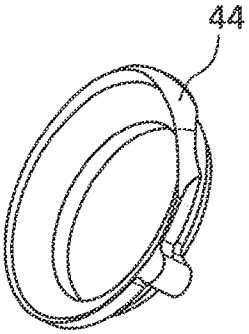
Figure 17B:
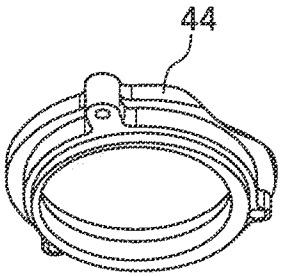
Figure 17E:
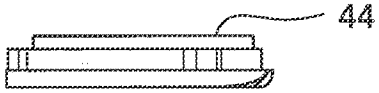
Figure 17C:
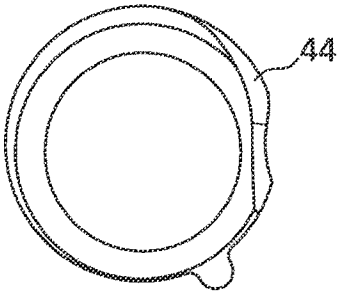
Figure 17F:
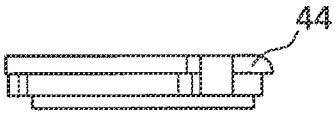
Figure 17D:
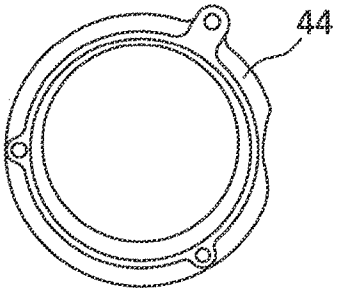
Figure 16E:
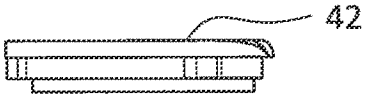
FIGS. 16*a*-16*f* are front perspective, rear perspective, front, rear, top and bottom views, respectively, of an insert for a first side of an archery release.
Figure 16C:
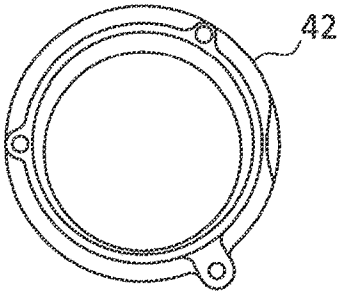
Figure 16F:
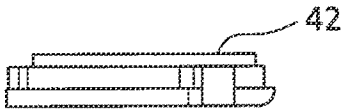
Figure 16D:
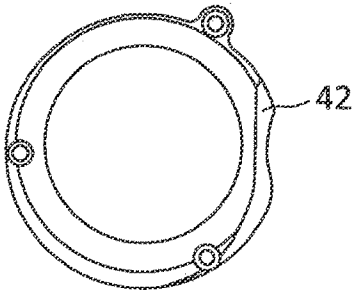
Figure 16A:
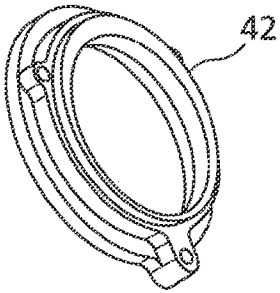
Figure 16B:
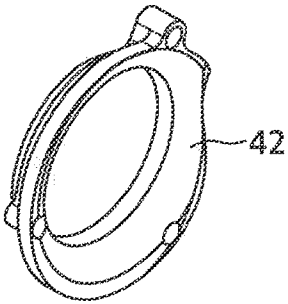

Referring to FIGS. 6 and 7, a sear assembly is connected with the handle. The sear assembly is operable between hold and fire positions for draw and release of an arrow. More particularly, the sear assembly includes a cocking bar 20 pivotally connected with the handle via a pivot pin 22, a toggle 24 pivotally connected with the handle via a pivot pin 26, and a bowstring hook 28 pivotally connected with the handle via a pivot pin 30. The hook includes a recess portion for receiving a bowstring or bowstring loop of a bow. The cocking bar is shown in detail in FIGS. 12*a*-12*d*, the toggle is shown in detail in FIGS. 15*a*-15*d*, and the hook is shown in detail in FIGS. 11*a*-11*e*. The cocking bar, toggle and hook all rotate or pivot about axes which are parallel to each other and normal to the longitudinal axis of the handle.

As shown in FIG. 7, an intermediate portion 20*a* of the cocking bar 20 extends from an opening in the bottom of the handle 2. The cocking bar is operable or pivotal between a cocked position and a release position. A spring 32 is arranged in the handle and abuts against the cocking bar to bias it to the release position when one of the index or pinky finger triggers is operated as will be developed below. A second spring 34 in the handle abuts against the toggle 24 and biases the toggle toward the hold position of the sear assembly. A spring element (not shown) normally biases the hook to the hold position in a conventional manner.

The index finger trigger 12 is pivotally connected with the handle via a pivot pin 36 as shown in FIGS. 7 and 7*a* and the pinky finger trigger 14 is pivotally connected with the handle via a pivot pin 38 as shown in FIGS. 7 and 7*b*. The index finger trigger is shown more particularly in FIGS. 13*a*-13*e* and the pinky finger trigger is shown more particularly in FIGS. 14*a*-14*f* Both triggers include contoured surfaces to support the respective fingers. Springs arranged between the handle and the triggers, respectively, bias the triggers to the hold position in a known manner.

The index and pinky finger triggers are operable between locked and released positions. Locking screws 40 are provided to lock the index and pinky finger triggers 12 and 14, respectively, so that they are prevented from pivoting. A locking screw is shown in more detail in FIG. 10. It includes a convex head portion 40*a* and a threaded portion 40*b*. The threaded portion of each screw is arranged in a respective threaded opening in each trigger so that the screw is laterally displaced relative to a trigger when it is rotated such as by a hex tool. The handle section 6 contains recesses 41 which are aligned with the lock screws of the index and pinky finger triggers, respectively, as shown in FIG. 6. Rotation of a locking screw in a locking direction displaces the screw so that the head portion enters the adjoining recess until the screw abuts against the inner surface of the section which defines the recess. This prevents the associated trigger from pivoting relative to the handle.

It will be appreciated by those of ordinary skill in the art that only one of the triggers should be operable at a time. Thus, if the archer desires to use the index finger trigger 12 to operate the release, the archer may lock the pinky finger trigger 14 via its locking screw. If the archer desires to use the pinking finger trigger, the index finger trigger may be locked.

The actuation of either the index finger or pinky finger triggers to fire an arrow will be described with reference to FIGS. 7, 7*a*, and 7*b* which show the release in the condition with the index finger trigger unlocked or activated and the pinky finger trigger locked or de-activated. The cocking bar includes a first portion 20*b* adapted to engage a sear 12*a* of the index finger trigger 12 and a second portion 20*c* adapted to engage a sear 14*a* of the pinky finger trigger 14 when the triggers are activated. The first and second portions are at opposite ends of the cocking bar.

In FIG. 7, the locking screw 40 for the index finger trigger 12 is turned fully in the counter-clockwise to remove the head of the screw from the corresponding recess in the handle section 6 to release the index finger trigger. As shown in FIG. 7*a*, the lip or sear 12*a* of the index finger trigger engages the lip or sear of the first portion 20*b* of the cocking bar 20. Referring back to FIG. 7, the locking screw 40 for the pinky finger trigger is turned fully in the clockwise direction to displace the locking screw head portion into the corresponding recess in the handle section 6 to lock the pinky finger and prevent it from pivoting. As shown in FIG. 7*b*, the lip or sear 14*a* of the pinky finger recess does not engage the lip or sear of the second portion 20*c* of the cocking bar.

Figure 3:
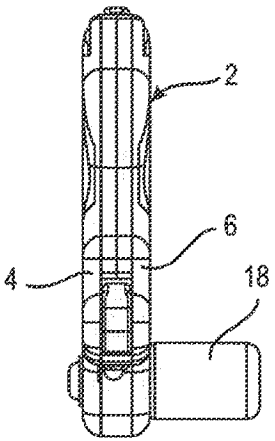
FIGS. 1-5 are front perspective, front, right side, bottom and bottom perspective views, respectively, of the archery release according to the disclosure.
Figure 2:
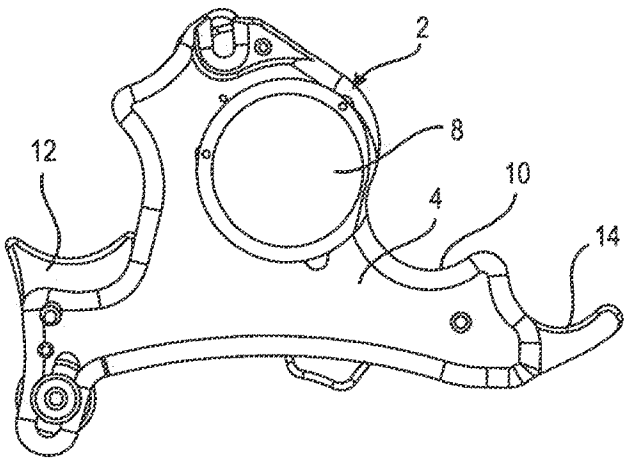
Figure 5:
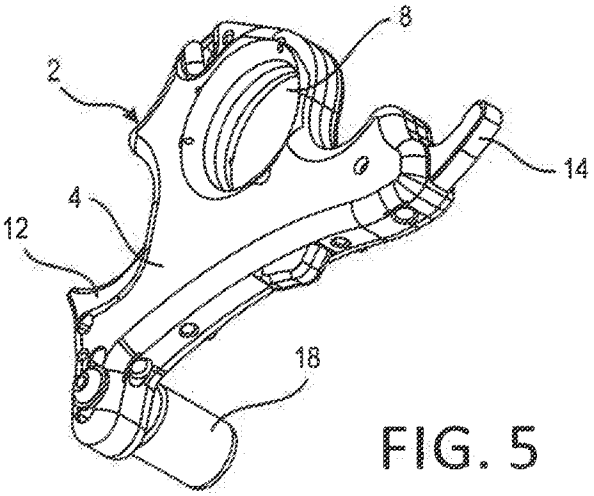
Figure 1:
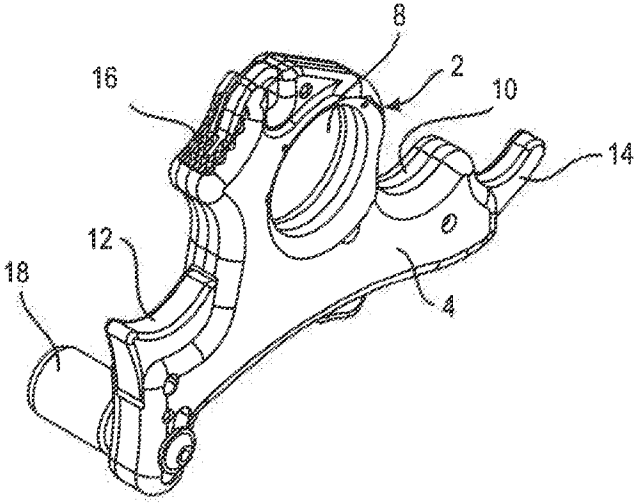
Figure 4:
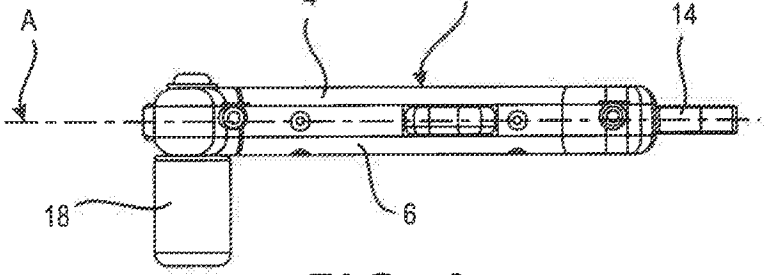

As shown in FIG. 1, the index finger trigger 12 and the pinky finger trigger 14 have longitudinal axes which are co-axial with the longitudinal axis of the handle 2. In addition, the index finger trigger is preferably narrower than the handle so that it is recessed from the side surface of the handle. This arrangement provides a disconnected feel for the release hand of the archer so that the archer cannot perceive minute movement of the trigger when firing the release. The knurled surface 16 of the handle is spaced from the index finger trigger. This surface is configured to support the index finger of the archer during draw of the bow. The release is thus configured to allow the archer to grip the release with the index, middle and fourth fingers via the surface 16, the opening 8, and the surface 10 and with the thumb via the thumb support 18 with enough force to fully draw the bow which preventing inadvertent engagement of the index finger trigger for premature firing of an arrow.

A further feature of the archery release is the use of removable inserts for the opening 8 of the handle. Referring once again to FIG. 6, an insert 42 is provided on the left or front surface of the handle section 4 and an insert 44 is provided on the right or rear surface of the handle section 6. The left side inserts are shown in detail in FIGS. 16*a*-16*f* and the right side inserts are shown in detail in FIGS. 17*a*-17*f*. The handle sections include recesses 46 in the portions thereof which define the handle opening 8. The recesses receive projections 48 on the outer surface of each insert. The inserts 42 and 44 include annular projections which are configured to mate within the opening 8. They are joined together with screws or other fasteners (not shown) which pass through openings in the projections. The inserts contain central openings. It will be appreciated that different inserts may be provided with central openings having different diameters which are less than the diameter of the handle opening 8. Thus, the archer may install inserts sized to fit the archer's middle finger and adjust the thumb support 18 to customize the release for maximum fit and comfort.

The archery release and its components described above are formed of a durable rigid material such as metal. Some components such as the inserts may be formed of synthetic plastic material for added comfort.

While the preferred forms and embodiments of the invention have been illustrated and described, it will become apparent to those of ordinary skill in the art that various changes and modifications may be made without deviating from the inventive concepts set forth above.

What is claimed is:

1. An archery release, comprising a flat finger bed handle having a longitudinal axis and including a pair of concave mating handle portions which define an internal cavity;

a sear assembly connected with said handle and operable between hold and fire positions; and an index finger trigger pivotally connected with said handle to selectively operate said sear assembly, at least a portion of said sear assembly and said index finger trigger being arranged within said cavity.

2. An archery release, comprising a flat finger bed handle having a longitudinal axis;

a sear assembly connected with said handle and operable between hold and fire positions;

an index finger trigger connected with said handle to selectively operate said sear assembly; and a pinky finger trigger connected with said handle to selectively operate said sear assembly.

3. An archery release as defined in claim 2, wherein said sear assembly includes a cocking bar pivotally connected with said handle between cocked and release positions, said cocking bar being released by one of said index and pinky trigger fingers to release said sear assembly.

4. An archery release as defined in claim 2, wherein said index and pinky trigger fingers are operable between locked and released positions, respectively.

5. An archery release as defined in claim 4, and further comprising a first spring arranged between said handle and said cocking bar to bias said cocking bar to said release position when one of said index and pinky finger triggers is operated.

6. An archery release as defined in claim 5, wherein said cocking bar includes a first portion which engages said index finger trigger when said index finger trigger is in the released position and which does not engage said index finger trigger when said index finger trigger is in the locked position.

7. An archery release as defined in claim 6, wherein said cocking bar includes a second portion which engages said pinky finger trigger when said pinky finger trigger is in the released position and which does not engage said pinky finger trigger when said pinky finger trigger is in the locked position.

8. An archery release as defined in claim 7, wherein said first and second portions are arranged at opposite ends of said cocking bar.

9. An archery release as defined in claim 7, wherein said sear assembly includes a toggle and a hook, said toggle and said hook each being pivotally connected with said handle, said cocking bar displacing said toggle toward the fire position of said hook when said cocking bar is in the release position.

10. An archery release as defined in claim 9, and farther comprising a second spring arranged between said handle and said toggle to bias said toggle toward the hold position.

11. An archery release as defined in claim 4, and further comprising a first locking screw for locking said index finger trigger relative to said handle when said pinky finger trigger is in the released position and a second locking screw for locking said pinky finger trigger relative to said handle when said index finger trigger is in the released position.

12. An archery release, comprising a flat finger bed handle having a longitudinal axis;

a sear assembly connected with said handle and operable between hold and fire positions; and an index finger trigger connected with said handle to selectively operate said sear assembly, wherein said index finger trigger has an axis which is co-axial with said handle longitudinal axis and wherein said handle includes a surface portion spaced from said index finger trigger and configured to support an index finger of an archer when an archery bow is drawn.

13. An archery release as defined in claim 12, wherein said handle contains a through opening having an axis which extends normal to said handle longitudinal axis, said through opening being configured to receive a middle finger of a release hand of the archer.

14. An archery release as defined in claim 12, and further comprising at least one insert removably connected with said handle, said insert containing an opening co-axial with said handle through opening and a diameter less than a diameter of said through opening, whereby different inner diameter inserts may be connected with said handle to improve the fit of the release in the archer's hand.

15. An archery release, comprising a flat finger bed handle having a longitudinal axis and containing a through opening having an axis normal to said longitudinal axis; and at least one insert removably connected with said handle in a fixed orientation, said insert containing an opening co-axial with said handle through opening and a diameter less than a diameter of said through opening, whereby different inner diameter inserts may be connected with said handle to improve the fit of the release in an archer's hand when a middle finger of the archer is arranged in said handle through opening.

16. An archery release, comprising a flat finger bed handle having a longitudinal axis and containing a through opening having an axis normal to said longitudinal axis;

at least one insert removably connected with said handle, said insert containing an opening co-axial with said handle through opening and a diameter less than a diameter of said through opening, whereby different inner diameter inserts may be connected with said handle to improve the fit of the release in an archer's hand when a middle finger of the archer is arranged in said handle through opening;

a sear assembly connected with said handle and operable between hold and fire positions; and an index finger trigger connected with said handle to selectively operate said sear assembly.

17. An archery release as defined in claim 16, wherein said sear assembly includes a cocking bar pivotally connected with said handle between cocked and release positions, said cocking bar being released by one of said trigger fingers to release said sear assembly.

18. An archery release as defined in claim 17, and further comprising a pinky finger trigger connected with said handle to selectively operate said sear assembly.

* * * * *